US005156580A

United States Patent [19]

Holland et al.

[11] Patent Number: 5,156,580

[45] Date of Patent: Oct. 20, 1992

[54] THERAPEUTIC TRACTION APPARATUS AND METHOD

[75] Inventors: Robert A. Holland, 409 S. Glebe Rd., Arlington, Va. 22204; Gary G. Reber, Springfield, Va.

[73] Assignee: Robert A. Holland, Arlington, Va.

[21] Appl. No.: 694,501

[22] Filed: May 2, 1991

[51] Int. Cl.[5] ..... A63B 1/00

[52] U.S. Cl. ..... 482/39; 482/38

[58] Field of Search ..... 272/62, 63, 109; 128/75

[56] References Cited

U.S. PATENT DOCUMENTS

| | | | |
|---|---|---|---|
| 715,530 | 12/1902 | Wallace | 272/62 |
| 860,517 | 7/1907 | Berglund | 272/63 |
| 1,495,536 | 5/1924 | Smith | 272/62 |
| 1,538,272 | 5/1925 | Cook | 272/62 |
| 1,757,825 | 5/1930 | Albach | 272/62 |
| 2,932,510 | 4/1960 | Kravitz | 272/62 |
| 3,117,760 | 1/1964 | Dresbach et al. | 272/62 |
| 3,642,278 | 2/1972 | Hinckley | 272/62 |
| 3,707,285 | 12/1972 | Martin | 272/62 |
| 3,735,979 | 5/1973 | Levenberg | 272/62 |
| 3,944,219 | 3/1976 | LoPresti | 272/62 |
| 3,975,106 | 8/1976 | Steele | 403/374 |
| 4,241,914 | 12/1980 | Bushnell | 272/136 |
| 4,372,552 | 2/1983 | Carlmark | 128/75 |
| 4,503,845 | 3/1985 | Licciardi | 128/75 |
| 4,657,242 | 4/1987 | Guridi | 272/62 |
| 4,772,011 | 9/1988 | Guridi | 272/62 |
| 4,927,135 | 5/1990 | Nieppola | 272/63 |

FOREIGN PATENT DOCUMENTS

| | | | |
|---|---|---|---|
| 3322506 | 11/1984 | Fed. Rep. of Germany | 272/62 |
| 2639240 | 5/1990 | France | 272/62 |

*Primary Examiner*—Richard J. Apley
*Assistant Examiner*—Lynne A. Reichard
*Attorney, Agent, or Firm*—Richard J. Johnson

[57] ABSTRACT

An apparatus for enabling a person to apply gentle gravity traction to his spine by suspending his body by the arms while supporting some of his weight with his legs. The apparatus is preferably constructed entirely of wood except for fastener elements and is designed to be assembled and disassembled quickly without the use of any tools. Included is a method of hanging from a support for treating an injured spine using a modified gravity traction procedure from that generally referred to as "long axis extension." A user grasps a support that has been positioned at a height such that he is able to maintain his spine and upper leg or thigh portions vertically aligned and with his lower leg portions horizontal to the floor and toes touching the floor enabling him to control the amount of weight to be supported by his arms.

6 Claims, 3 Drawing Sheets

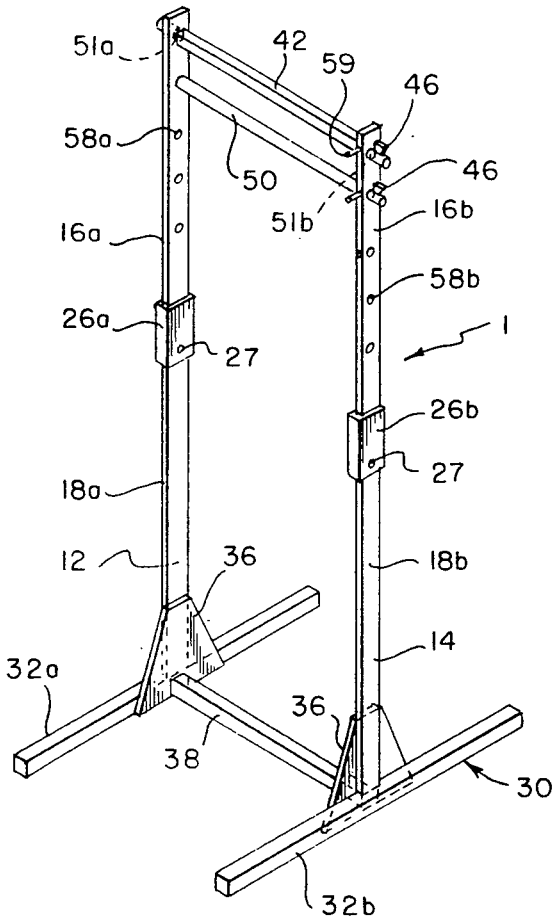
FIG. 1
FIG. 2
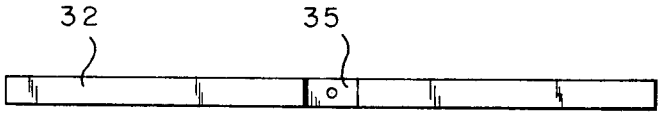
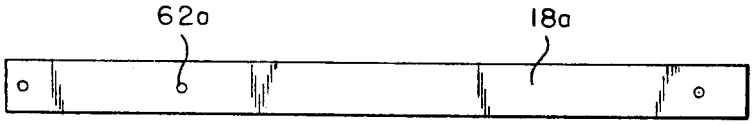
FIG. 3
FIG. 4
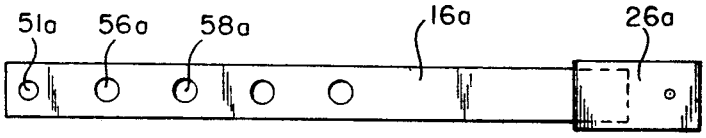
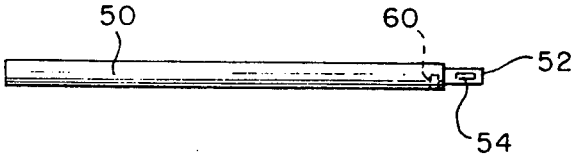
FIG. 10

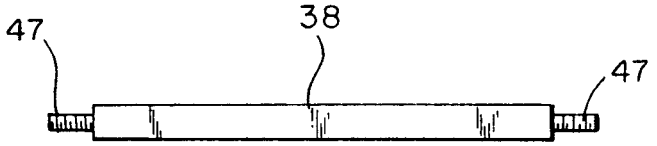
FIG. 5
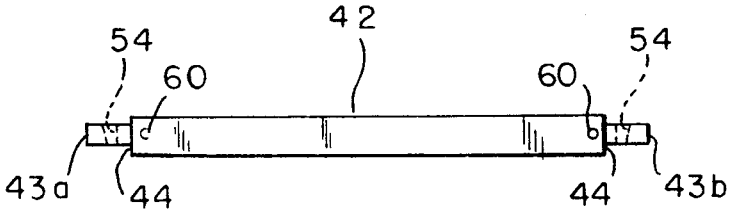
FIG. 6
FIG. 7
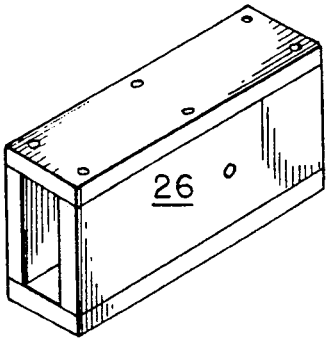
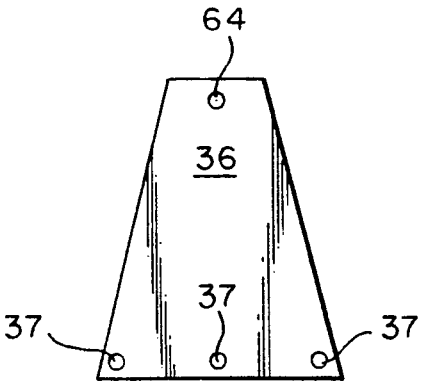
FIG. 8
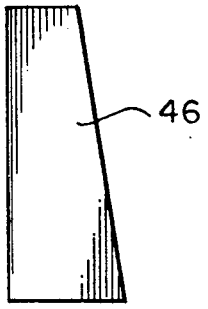
FIG. 9

THERAPEUTIC TRACTION APPARATUS AND METHOD

BACKGROUND OF THE INVENTION (1) Field of Art of the Invention

This invention relates to an apparatus for enabling a person to apply gentle traction to the human spine by suspending the body by the arms while supporting some of his weight with his legs. The procedure of hanging by the hands and using gravity to provide traction forces to the spine is termed long axis extension. Included is a method of treating an injured spine.

(2) Description of the Related Art

The prior art includes a number of devices that have been proposed for hanging by the arms. Examples of such include:

Carlmark, U.S. Pat. No. 4,372,552 discloses a hang stand wherein a user hangs by his hands while a support behind his back maintains his spine in a correct alignment.

Bushnell, U.S. Pat. No. 4,241,914 discloses an exercise apparatus for a person hanging by his arms wherein a resistance member attached to the frame near his feet may increase or decrease the amount of weight supported by his arms.

Simon, U.S. Pat. No. 3,896,798 discloses a therapeutic traction apparatus wherein a user hangs by his shoulders from a pair of parallel bars. Footrests are provided to initially position himself and for rest.

Steele, U.S. Pat. No. 3,975,106 discloses a tapered wedge used to assemble scaffolding members.

Other patents of general interest are: 4,772,011, 3,642,278, 3,707,285, 3,944,219, 2,932,510, 860,517, 4,503,845, 1,495,536, and 4,657,232.

(3) Summary of the Invention

The prior art has recognized that hanging by the arms can be beneficial in assisting the rehabilitation of a person with an injured spine. However, the various known hanging devices do not appear to recognize the hazards involved when a user with an injured spine attempts to support his entire weight with his arms or if while doing so he suddenly changes the loading forces on the injured spinal discs such as upon release of his hands and dropping to the floor.

In order to compensate for the potential difficulties arising from full non-weight-bearing hanging (feet entirely free from the floor), a modification of known techniques for implementing this exercise is important. Some of the potential dangers to the user arising from full weight-bearing hanging include: trauma to shoulder articulation and/or attached soft tissue; exacerbation of the symptoms as a result of the sudden increase of compressive forces on the spine, especially in cases of acute low back inflammation, upon the release of the hands and the ensuing drop of the body to the floor.

Applicant has discovered a more gentle method of stretching the elastic soft tissues (muscles, fascia) that provide support to the axial skeleton, in particular the lumbo-pelvic section. The end result of the improved method is that the bodies response to gravity will produce decompression and partial unloading of the compression forces and allow for a fuller range of motion at the spinal segmental level without the inherent dangers of the prior art methods and hanging devices.

Thus, the invention relates in part to a method, and in part to an apparatus, that will allow the user to gently and gradually shift a desired portion of the compressive forces to his spine to gentle tension forces while maintaining a proper alignment of his spine and his thighs to reduce the possibility of further injury to the person.

As is well known, persons experiencing severe back pain may be in such discomfort as to be unable to walk and thus travel to a doctor's office where treatment could be performed. In such instances, before a patient can travel to obtain treatment, it is necessary for emergency measures to be performed at the person's home where needed equipment for spinal manipulation is unavailable.

A need exists for practitioners, such as chiropractors, to have available a hanging apparatus that can be easily transported to a patient's home and assembled by unskilled persons in a minimum of time and effort for treating such generally incapacitated persons until they are at least somewhat mobile. To such end the invention is designed to occupy a minimum of space and require no additional support from walls, ceilings, or doors as is required in many prior art devices. Because of the unique design the invention will have special usefulness in doctors' offices.

Thus, individual frame members are designed to be light in weight and easily assembled and disassembled by persons who may be unskilled mechanically without the use of tools of any kind. The device is designed to be sturdy in use and to occupy a minimum of space when assembled either in a doctor's office or in a patient's home.

A primary object of the invention is to provide a frame by which a person may hang by his arms with a portion of the weight sustained by his legs and which may be quickly assembled and disassembled so as to be easily stored or transported and reassembled with a minimum of time and effort.

A further object is to provide a method of using the hanging frame to maximize the benefits therefrom.

A further object is to provide an improved method of using a hanging apparatus to relieve spinal discomfort and to gently alleviate spinal abnormalities. These and other objects will become apparent from the description which follows.

BRIEF DESCRIPTION OF THE DRAWINGS

FIG. 1 is a perspective view of the assembled hanging frame.

FIG. 2 is a front view of the bottom rail.

FIG. 3 is a side view of the lower portion of one of the side frame members.

FIG. 4 is a side view of the upper portion of one of the side frame members.

FIG. 5 is a side view of the base stretcher member.

FIG. 6 is a side view of one of the hanging stretcher members.

FIG. 7 is a perspective view of the connecting sleeve.

FIG. 8 is a front view of the base reinforcing member.

FIG. 9 is a front view of one of the securing wedges.

FIG. 10 is a front view of the hanging bar.

DETAILED DESCRIPTION OF THE INVENTION

Figure 11:
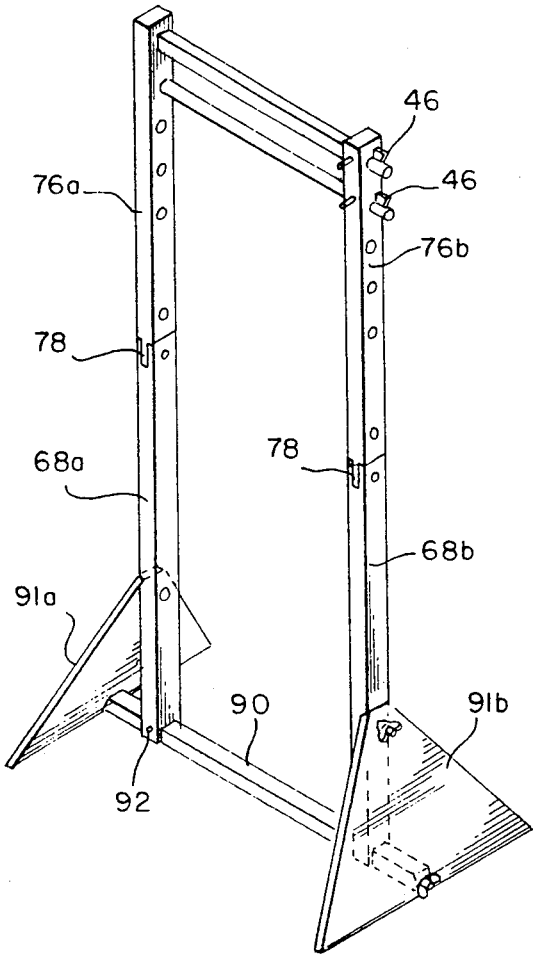
FIG. 11 is a perspective view of a modified structure.

In the drawings, like numbers represent like parts, with letters being added to such numbers where necessary to facilitate describing the invention. Reference will now be made to the drawings for a detailed description of the invention with the use of such numerals.

Referring first to FIG. 1, the hanging frame apparatus is referred to in general by the numeral 10. Hanging frame 10 is preferably constructed almost entirely from wood, although it could obviously be constructed from other well known materials. As best viewed in FIG. 1 the frame includes left and right vertical side support rail members 12 and 14, respectively. For convenience the left side components include the letter "a" while right side components are given the letter "b." Left side support member 12 includes an upper portion 16*a* and a lower portion 18*a*. Support member 14 includes an upper portion 16*b* and a lower portion 18*b*, respectively. The upper and lower rail portions are removably joined at their central portions by sleeve members 26*a*, 26*b* which are generally in the form of hollow rectangular boxes. Each sleeve member is attached in a substantially permanent manner to a respective upper portion 16*a*, 16*b* and is removably secured to the lower half portion 18*a*, 18*b*, by fastening means, such as a single bolt and wing nut illustrated at 27.

The support base 30 includes a pair of laterally spaced bottom rails or feet 32*a*, 32*b* each secured at a respective central portion to the lower end of a respective lower side support member 18*a*, 18*b* which is received in recessed portion 35. A triangularly shaped gusset stiffener brace 36 is positioned on the inner surfaces of the feet 32*a*, 32*b* and the lower side support members 18*a*, 18*b*, and is removably secured thereto with bolts and wing nuts 27. A base spreader bar 38 having a threaded stud 47 in and projecting from each end is positioned between the spaced feet with the respective studs 47 passing through aligned openings in the braces 36, lower members 18*a*, 18*b*, and feet 32*a* 32*b*. Wing nuts 27 (not shown in FIG. 1) threaded to studs 47 securely but removably clamp these members. The base spreader bar 38 thus maintains the side rails a fixed distance apart.

Positioned between and securing the upper ends of the side rail support members 12, 14, is an upper spreader bar 42. Bar 42 has reduced diameter end portions 43*a*, 43*b*, slidably received in the upper set of aligned holes 51*a*, 51*b*. The reduced diameter end portions provide shoulders 44 that abut the inner surfaces of the side rail members to fix the distance therebetween. End portions 43*a*, 43*b*, include diametrically disposed rectangular openings 54 (see FIG. 6) having tapered outer end walls to receive tapered wedge members 46 which serve to removably fix the upper spreader bar and the upper ends of the side rail members in position.

A second or hanging bar 50, (see FIG. 10) which is circular in cross-section, has a reduced diameter portion 52 on one end. It will be noted that the openings 58*a* in rail member 16*a* are of larger diameter 25 than the openings 58*b* in rail member 16*b*. Thus, the nonreduced end of the hanging bar 50 is merely slidably received in a selected one of the openings 58*a* in the upper side rail 16*a* whereas the opposite reduced diameter end 54 is inserted in a correspondingly sized opening 58*b*. The reduced diameter portion 52 also includes a diametrically disposed opening 54 to receive a tapered wedge member 46. A metal pin 59 is inserted through an opening in an edge portion of at least one of the side rails 16*a* or 16*b* and into a diametrical opening 60 in the hanging bar 50 to keep it from rotating. A similar pin 59 may be used at each end of the upper spreader bar 42 to keep the bar from rotating and thus prevent the accidental removal of the wedge member 46.

ASSEMBLING THE HANGING FRAME

To assemble the frame, the feet 32*a*, 32*b* are placed on a flat surface. The lower ends of the respective rail portions 18*a*, 18*b*, are placed in the recesses 35 and fixed in position using a gusset brace 36 and secured with bolts and wing nuts 27. The threaded studs 47 of the base spreader 38 are then inserted through the openings 37 in the gusset braces and the aligned openings in the lower rail portions 18*a*, 18*b*, and feet 32*a*, 32*b*, respectively and secured using a single wing nut on each end. The lower ends of the upright support members 18*a*, 18*b* are rigidly secured using a single bolt passed through the spaced holes 62*a*, 62*b*, therein and upper openings 64 in the gusset braces 36. Additional reinforcement such as gussets may be provided at this connection to reduce the possibility of lateral sway of the rail members.

The upper support portions 16*a*, 16*b*, having a connecting sleeve 26*a*, 26*b*, respectively, fixedly attached thereto, are telescoped over the upstanding ends of the lower support rail portions 18*a*, 18*b* and are secured with a single bolt and wing nut assembly 27. Next, the reduced ends of the spreader bar 42 are inserted in the uppermost openings 51*a*, 51*b*. A tapered wedge 46 is then inserted with slight finger pressure into each opening 54. The wedges are self-tightening and require very little pressure to force them into the openings 54. Finally, the reduced end 54 of the hanging bar 50 is inserted through a selected opening 56*a* in left side rail frame 16*a* and across the opening in the frame into an aligned but smaller diameter opening 56*b* in the right side rail 16*b* until the shoulder thereon abuts the inner surface of the side rail whereupon a tapered wedge 46 is inserted in the elongated opening 54. Lock pins 59 are then inserted in openings 60 in each of the bars to prevent them from rotating. The hanging stand is then ready to be used. Disassembly of the frame for transport or storage is readily accomplished by reversing the above procedure.

MODIFICATION

In FIG. 11, a modified hanging stand is illustrated. This embodiment is generally similar to the previously described structure except for the support base and the connection between the upper and lower side members. Sleeve member 26 is replaced with a tongue and groove connection 78 secured by a single bolt and wing nut.

The modified support base includes left and right generally triangular panel members or feet 91*a* and 91*b*, respectively. Modified spreader bar 90 extends beyond the side rail members and includes a threaded stud projecting from each end thereof which is inserted into an opening in the lower edge of the respective panel members and secured by a wing nut. A bolt and wing nut 92 may be used to secure the lower ends of the side rail members to the base spreader bar 90. The outer ends of the spreader bar 90 are angled inwardly and upwardly to conform to the angled inner faces of the panel members 91*a*, 91*b*.

The modified hanging stand is assembled and disassembled in a manner similar to the first embodiment. Again no tools are needed for such assembly or disassembly.

THE METHOD OF USING THE APPARATUS

Figure 12:
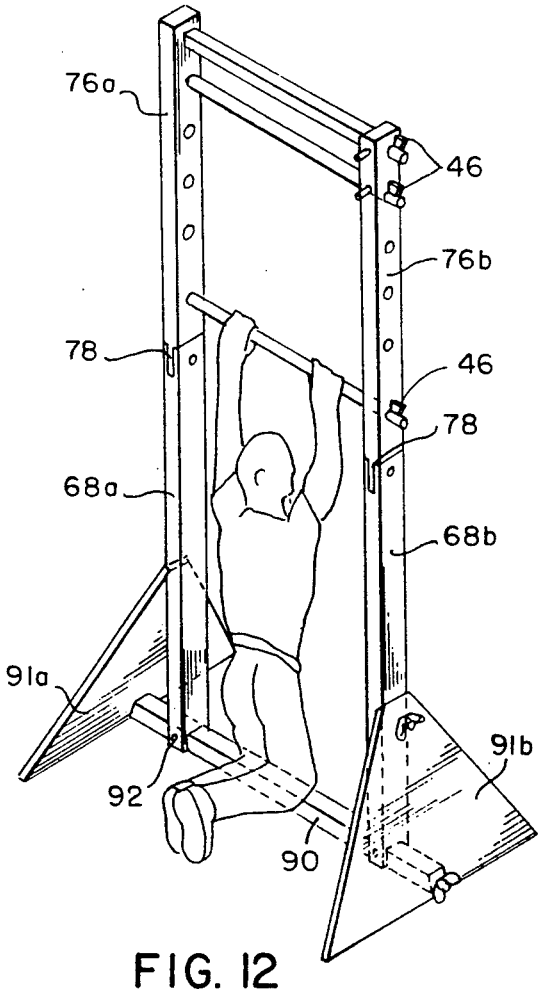
FIG. 12 illustrates the position of a user's body while practicing the method and hanging from the frame.

Having assembled the frame the user positions himself between the side members and adjusts the height of the hanging bar 50 such that when hanging by his hands his thigh portions are generally aligned with his spine and his lower leg portions are generally horizontal and parallel to the floor as illustrated in FIG. 12. The feet are generally perpendicular to the floor with only his toes contacting the floor. By changing the height of the bar 50, the user may adjust the amount of weight that may be supported by his legs and thus the extension forces that are placed on the soft connecting tissue of the spine. However, the preferred position while hanging is to have the lower legs together and generally parallel to the floor even if it is possible to do so for only a few seconds at a time. A gentle controlled stretching of the elastic tissues that provide support to the axial skeleton, in particular the lumbo-pelvic section is achieved.

Sudden increases or decreases in weight or shock forces applied to such tissue may result in exacerbation of the symptoms, which is possible using prior art devices, are greatly reduced. Further, the danger of sudden release of the hands upon termination of the session with resulting dropping of the body to the floor with similar damaging results is also substantially eliminated using the apparatus and method disclosed herein since at least the toes of the user's feet always remain in contact with the floor.

We claim:

1. A portable hanging stand for therapeutic purposes whereby a user may hang suspended by his arms under the influence of gravity, said stand comprising the following detachably connected components: a pair of laterally spaced upright side support members interconnected at their upper ends by an upper spreader bar and at their lower ends by a lower transverse spreader bar, said lower transverse spreader bar extending laterally outwardly beyond the upright support members, each side support member comprising connected upper and lower portions, the upper side portions including a plurality of vertically spaced pairs of transversely aligned openings, said upper spreader bar including end fastening portions fitted into the uppermost set of aligned openings and detachable fastening means securing said end fastening portions to said upper side portions, a hanging bar for grasping by a user's hand slidably removably disposed in a selected additional pair of said aligned openings, longitudinally extending support feet secured to opposite ends of said lower spreader bar, said feet comprising generally triangularly shaped panel members angled upwardly and inwardly from the lower transverse spreader bar ends and detachably secured to the upright support members, and each of said components being detachably connected to form said hanging stand and adapted to be disassembled for transport.

2. The subject matter of claim 1 wherein the hanging stand is constructed substantially entirely from wood.

3. The subject matter of claim 1 wherein detachable fastening means comprising threaded members and wing nuts connected said components.

4. The subject matter of claim 1 wherein the hanging bar end portions include rectangular slots upwardly adjacent the side portions and tapered wedges received in the slots.

5. The subject matter of claim 4 wherein one end of the hanging bar which is fitted into one of the aligned side member openings includes a reduced diameter portion.

6. The subject matter of claim 1 wherein each of the lower side members include a hollow upper end portion into which the respective lower end portions of the upper side members are received and detachably secured.

* * * * *